United States Patent [19]

Hendricks et al.

[11] Patent Number: 4,914,989

[45] Date of Patent: Apr. 10, 1990

[54] WRENCH FOR REMOVAL OF A STUD-NUT FROM AN OUTER NUT

[76] Inventors: Donald R. Hendricks, 2272 E. 34th, Tulsa, Okla. 74105; James M. McClanahan, 4328 E. 66th St., Tulsa, Okla. 74136

[21] Appl. No.: 202,972

[22] Filed: Jun. 3, 1988

[51] Int. Cl.[4] ..... B25B 23/08

[52] U.S. Cl. ..... 81/462; 81/13

[58] Field of Search ..... 81/13, 462, 487, 55, 81/DIG. 1

[56] References Cited

U.S. PATENT DOCUMENTS

| | | | |
|---|---|---|---|
| 1,261,006 | 4/1918 | Bartelt | 81/13 |
| 2,305,274 | 12/1942 | Power | 81/13 |
| 2,454,027 | 11/1948 | Baeza | 81/55 |
| 4,191,235 | 3/1980 | Davis | 81/13 X |
| 4,364,288 | 12/1982 | Castoe | 81/55 X |

*Primary Examiner*—D. S. Meislin

*Attorney, Agent, or Firm*—Bill D. McCarthy

[57] ABSTRACT

An improved wrench for use in combination with a lug wrench for removing a stud-nut of a double cap nut assembly from an outer nut of a wheel assembly, the wrench comprising an elongated body member having a nut-receiving first end portion and a second end portion; a leg member supported by the body member near the opposed second end extending normal to an elongated axis of the body member; and a shoulder assembly supported by the leg member for engaging a portion of the wheel to prevent removal of the leg member when torque is applied to the nut-stud of the double cap nut assembly.

6 Claims, 2 Drawing Sheets

WRENCH FOR REMOVAL OF A STUD-NUT FROM AN OUTER NUT

BACKGROUND OF THE INVENTION

1. Field of the Invention

The present invention relates to a wrench for use in combination with a lug wrench for removal of a stud-nut from an outer nut of a double cap nut assembly used to secure a wheel assembly to a hub of the vehicle.

2. Discussion of Prior Art

Dual wheel assemblies are commonly used on trucks to improve tire wear and fuel economy, as well as to reduce vibration and thus provide a smoother ride. When employing dual wheels the inner and outer wheel assemblies are secured to the studs of a vehicle's axle hub by a double cap nut assembly. The double cap nut assembly includes a stud-nut (inner nut) and an outer nut. The stud-nut, a square-headed member having an internal threaded bore and external threads, is screwed into each vehicle hub stud and then the outer nut is screwed onto the stud-nut.

The unique arrangement of the double cap nut assembly permits one to readily remove the inner wheel assembly from the vehicle truck using a lug wrench, such as a pneumatic wrench. However, problems arise in the removal of the stud-nut from the outer nut of the double cap nut assembly used to connect the outer wheel of the vehicle to the axle hub because the outer nut and the nut-stud are often "frozen" which requires special procedures for removal, and thus can lead to potential damage to the wheel assembly, including the stud-nut and/or outer nut.

To assist in the removal of the stud-nut from the outer nut of the double cap nut assembly a nut wrench was developed. This prior art nut wrench consists of a wrench body having at one end a hexagonal opening and a perpendicularly extending extension at the opposed end thereof. The hexagonal opening of the body is adapted to be placed about the outer nut of the double cap nut assembly, and the extension at the opposite end thereof to be placed within a stud-receiving opening in the wheel assembly (which does not contain a stud) or adjacent a portion of a rim of the wheel assembly. The nut wrench of the prior art is designed to hold or secure the outer nut of the double cap nut assembly so as to prevent rotation of the outer nut when a pneumatic wrench is used to remove the stud-nut therefrom.

The nut wrench of the prior art described above can be highly dangerous to the user. For example, in utilizing the prior art nut wrench the user must hold or press the nut wrench against the wheel to maintain the extension member of the wrench within the stud-receiving opening of the wheel or adjacent the rim of the wheel assembly. Because of the torque generated when pneumatic wrenches are used to remove the stud-nut from the outer nut of the double cap nut assembly, the user cannot always maintain the prior art wrench in place which results in injury to the user, damage to the stud-nut of the double cap nut assembly (such as shearing) and damage to the surface of the wheel created by rotation of the wrench.

Thus, while the prior art wrench has met with some success, the need still remains for an inexpensive, durable wrench which can be used in combination with a lug wrench, such as pneumatic wrench, to remove the stud-nut from the outer nut of the double cap nut assembly without requiring the user to support such wrench with the user's hand or foot; and which does not inadvertently dislodge from contact with the wheel assembly and thereby spin due to torque generated by a pneumatic wrench when a pneumatic or manual wrench is employed to remove the stud-nut from the outer nut of the double cap nut assembly. It is to such a wrench or hand implement that the subject invention is directed.

SUMMARY OF THE INVENTION

According to the present invention an improved wrench or hand implement for use in combination with a lug wrench is provided which enables one to safely and efficiently remove a stud-nut from an outer nut of a double cap nut assembly of a wheel assembly. The wrench, which does not require the user to expose himself to danger by the use of a hand or foot to stabilize the wrench, comprises an elongated body member having a first end portion defining a nut-receiving opening therein and an opposed second end, a leg member supported by the body member near the opposed second end thereof such that the leg member extends normal to an elongated axis of the body member, and a shoulder assembly supported by the distal end portion of the leg member for engaging a portion of the wheel defining the stud-receiving openings in the wheel. The nut-receiving opening defined by the first end portion of the elongated body member is provided with a configuration substantially corresponding to the circumferential configuration of the outer nut of the double cap nut assembly; and the leg member of the wrench is disposed a distance from a central axis of the nut-receiving opening so that the distance therebetween corresponds to the distance between central axes of adjacent stud-receiving openings in the wheel assembly.

An object of the present invention is to provide a wrench for removing a stud-nut from an outer nut of a double cap nut assembly.

Another object of the present invention, while achieving the before-stated object, is to provide a wrench which will enable one to safely and efficiently remove a stud-nut from an outer nut without requiring one to stabilize the wrench with one's hand or foot.

Yet another object of the present invention while achieving the before-stated objects, is to provide a wrench for use in combination with a pneumatic lug wrench adapted to remove a stud-nut from an outer nut which is durable in construction, economic to manufacture and which overcomes the disadvantages of the prior art wrench.

Other objects, advantages and features of the present invention will become apparent upon reading of the following description when read in conjunction with the drawings and appended claims.

DETAILED DESCRIPTION

Figure 1:
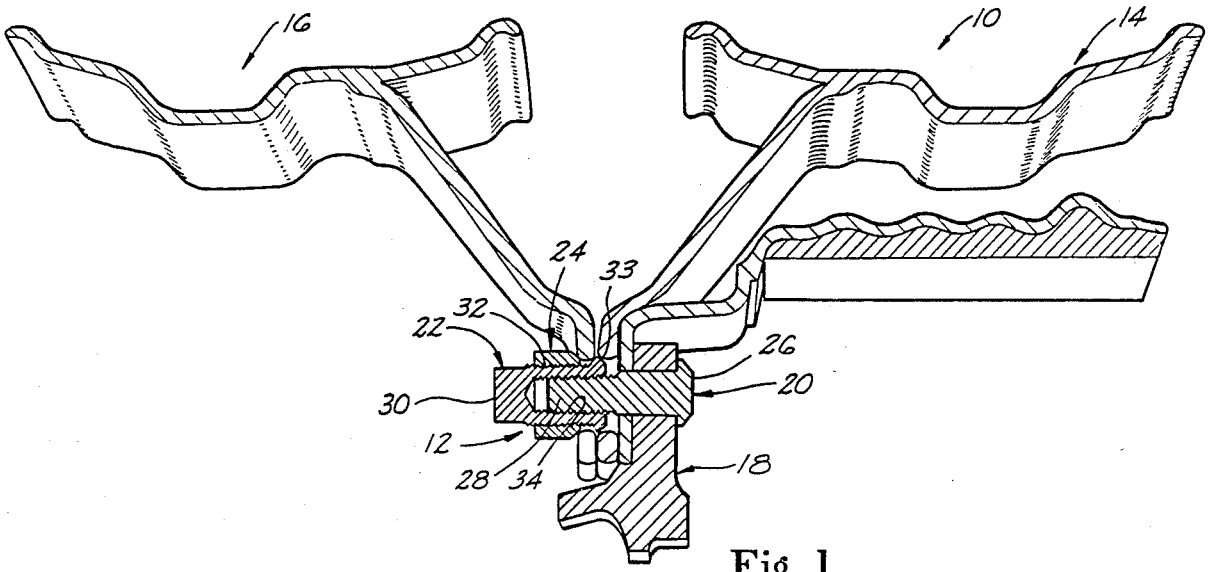
FIG. 1 is an isometric, partially cut-away view of a portion of a conventional disc wheel system wherein dual wheels (inner and outer wheels) are secured to a stud of an axle hub of vehicle by a double cap nut assembly.

Referring now to the drawings, and more particularly to FIG. 1, a disc wheel assembly 10 is illustrated wherein a double cap nut assembly 12 is employed to mount an inner wheel 14 and an outer wheel 16 to an axle hub 18 of a vehicle (not shown). The double cap nut assembly 12, which functions as a lug nut or bolt for a stud 20 extending from the axle hub 18, comprises a stud or inner nut 22 (hereinafter referred to as stud-nut 22) and an outer nut 24. The stud 20 and the stud-nut 22 cooperate to secure the inner wheel assembly 14 to the axle hub 18; whereas, the stud-nut 22 and the outer nut 24 cooperate with the stud 20 to secure the outer wheel assembly 16 to the axle hub 18.

Figure 2:
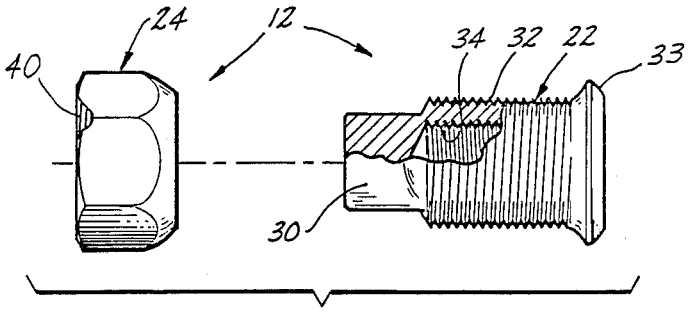
FIG. 2 is a partially exploded, cut-away, elevational view of a stud-nut (inner nut) and an outer nut of the double cap nut assembly.

The stud 20 is characterized as having a head or first end 26 and a threaded second end portion 28; whereas the stud-nut 22 is characterized as having square-shaped first end portion 30 and a cylindrical-shaped, externally threaded second end portion 32 having a flared distal end 33 substantially as shown in FIG. 2. The externally threaded second end portion 32 of the stud-nut 22 is also provided with an internal threaded bore 34. Thus, the threaded end portion 28 of the stud 20 extends outwardly from the hub axle 18 for mating engagement with the internal threaded bore 34 of the stud-nut 22 to secure the inner wheel assembly 14 and a brake drum 36 to the axle hub 18 substantially as shown in FIG. 1.

As previously stated, the stud-nut 22 and the outer nut 24 cooperate to secure the outer wheel 16 to the axle hub 18. Thus, the external threads on the cylindrical-shaped second end portion 32 of the stud-nut 22 are adapted to matingly engage internal threads 40 of the outer nut 24.

Figure 3A:
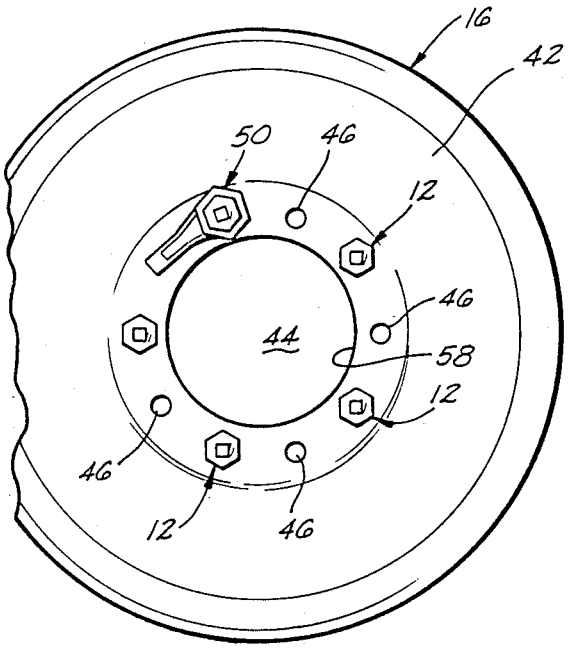
FIG. 3A is a plan view of a wrench wherein a nut-receiving opening is positioned on the outer nut of the double cap nut assembly such that a leg member of the wrench is disposed through an adjacently disposed stud-receiving opening of the wheel assembly.
Figure 3B:
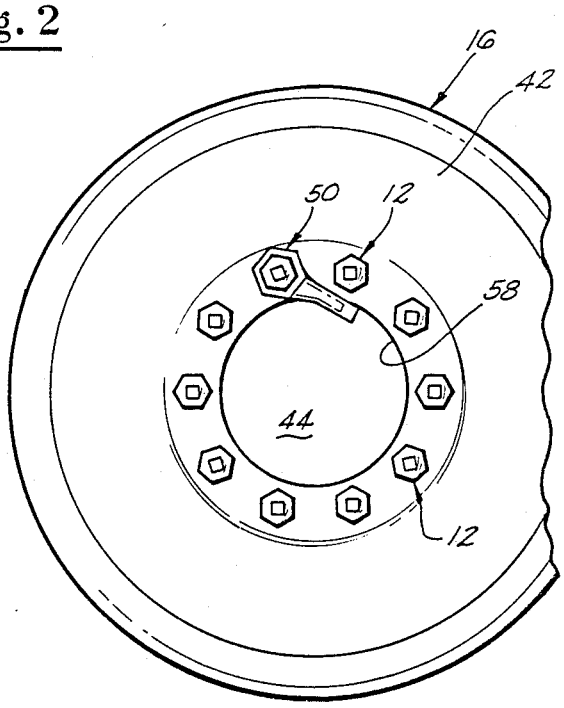
FIG. 3B is a plan view of the wrench wherein the nut-receiving opening of the wrench is positioned on the outer nut of the double cap nut assembly such that the leg member of the wrench extends along a rim of the wheel assembly in an abutting position.

The interconnection of the stud 20, and the stud-nut 22 and the outer nut 24 of the double cap nut assembly enables one to operably connect the inner and outer wheels 14, 16 of a vehicle (not shown) to the axle hub 18 of the vehicle. When it is desired to remove the inner and outer wheels 14, 16 from the axle hub 18 of the vehicle for maintenance or replacement, the inner wheel 14 can be removed by applying a torque to the stud-nut 22 such that the stud-nut 22 is rotated and removed from the stud 20. Generally, one does not encounter problems in removing the inner wheel 14 from the vehicle. However, problems are often incurred in removing the stud-nut 22 from the outer nut 24 because usage of the vehicle has a tendency to "freeze" the outer nut 24 to the stud-nut 22 of the double cap nut assembly 12. In such instances, in order to prevent damage to the stud-nut 22, or the outer wheel assembly 16 (particularly a rim 42 of the wheel assembly 16), a nut wrench is employed for stabilizing the outer nut 24 so that the stud nut 22 can be removed therefrom by the application of torque. The stabilizing of the outer nut 24 is generally accomplished using a nut wrench wherein the nut wrench is selectively positioned on the outer wheel assembly 16 substantially as shown in FIGS. 3A and 3B.

The outer wheel assembly 16 comprises the rim 42 on which a tire (not shown) is mounted. The rim 42 is provided with a centrally disposed hub opening 44 and a plurality of equally spaced stud-receiving openings 46 disposed about the hub opening 44. A plurality of double cap nut assemblies 12 are employed to secure the outer wheel assembly 16 to the axle hub 18 via studs 20. As shown in FIG. 3A the double cap nut assemblies 12 are positioned in alternating stud-receiving openings 46 of the rim 42; whereas in FIG. 3B one of the double cap nut assemblies 12 is employed in each of the stud-receiving openings 46 of the rim 42.

Figure 4:
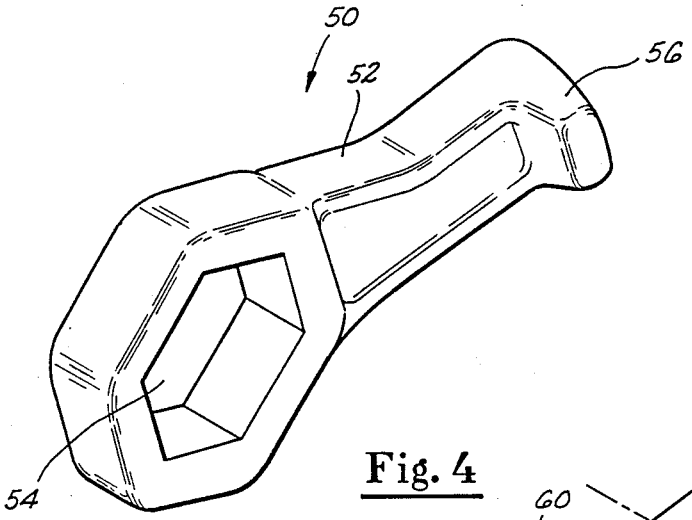
FIG. 4 is an isometric view illustrating the wrench of the prior art wherein the wrench is viewed from a lower side thereof.

A wrench or implement 50 (as illustrated in FIG. 4 as a prior art wrench) or a wrench or implement 60 (as constructed in accordance with the present invention and as hereinafter described with reference to FIGS. 5, 6A, 6B and 7) can be utilized to remove the stud-nut 22 from the outer nut 24 of each of the double cap nut assemblies 12. However, for reasons which will be set forth hereinafter, the wrench 60 of the present invention overcomes many of the disadvantages of the prior art wrench 50 described with reference to FIG. 4.

Referring now to FIG. 4, the prior art wrench 50 comprises an elongated body member 52 having a hexagonal-shaped opening 54 formed in one end thereof, and a substantially normally disposed extension member 56 extending from the opposed end of the body member 52. The hexagonal opening 54 of the wrench 50 is configured to correspond substantially to the circumferential configuration of the outer nut 24 of the double cap nut assembly 12, and the extension member 56 is adapted to be positioned within an adjacent stud receiving opening 46 of the rim 42 (as shown in FIG. 3A), or to abut a shoulder portion 58 of the rim 42 (substantially as shown in FIG. 3B).

The wrench 50 is designed to secure the outer nut 24 of the double cap nut assembly 12 (that is, to prevent the outer nut 24 from rotating), when a lug wrench, such as a pneumatic wrench, is connected to the square-shaped first end portion 30 of the stud-nut 22 and torque is applied so that the stud-nut 22 can be removed from the outer nut 24.

While the concept of the wrench 50 is sound (and similar to the wrench 60), practical use of the wrench 50 is not totally successful and can be very dangerous. For example, to utilize the wrench 50 the user must hold or press the wrench 50 against the rim 42 of the outer wheel assembly 16 in order to maintain the wrench 50 in the desired position while a torque is applied to the stud-nut 22. Because of the amount of torque generated by pneumatic wrenches, which are commonly employed to remove the stud-nut 22 from the outer nut 24, the extension member 56 of the wrench 50 often is rotatably removed from either the stud-receiving opening 46 or from engagement with the shoulder 58 of the rim 42. When such occurs the stud-nut 22 can shear, or the wrench 50 can spin, thus damaging the rim 42 of the inner wheel assembly 14 or causing injury to the user's hand or foot which is being employed to hold the wrench 50 in the desired position.

The improved wrench or implement 60 of the present invention overcomes the before-mentioned disadvantages of the prior art wrench 50, and substantially eliminates the possibility of shearing the stud-nut 22, damaging the rim 42 of the outer wheel assembly 16, or placing the user in a precarious position wherein injury can occur.

Figure 5:
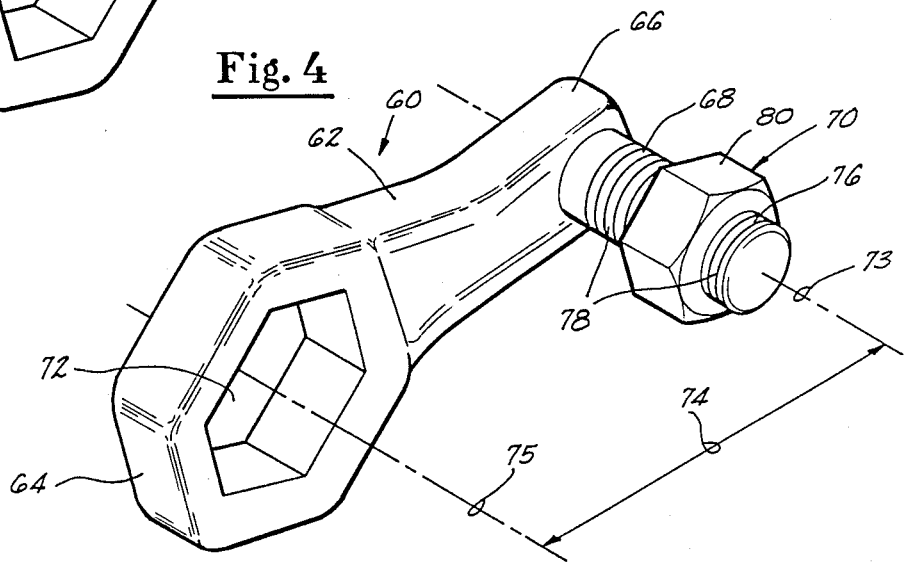
FIG. 5 is an isometric view of the wrench of the present invention when the wrench is viewed from a lower side thereof and illustrating one embodiment of a shoulder assembly secured to the leg member of the wrench for stabilizing the leg member in either a stud-receiving opening of the wheel assembly or adjacent the rim portion thereof.

Referring now to FIG. 5, the wrench 60, which is also used in combination with a lug wrench (not shown) to remove the stud-nut 22 from the outer nut 24 of the double cap nut assembly 12, is illustrated. The wrench 60 comprises an elongated body member 62 having a first end portion 64 and an opposed second end 66, a leg member 68 supported by the body member 62 near the opposed second end 66 thereof, and a shoulder assembly 70. The first end portion 64 of the body member 62 defines a substantially hexagonal-shaped nut-receiving opening 72 therein corresponding to the circumferential configuration of the outer nut 24 of the double cap nut assembly 12.

The leg member 68, which extends substantially normal to an elongated axis of the body member 62, is positioned on the body member 62 so that a central axis 73 of the leg member 68 is disposed a distance 74 from a central axis 75 of the nut-receiving opening 72. The distance 74 is established to equal to the distance between the central axes of two adjacently disposed stud-receiving openings 46 in the rim 42 of the outer wheel assembly 16. Further, the leg member 68 is provided with a length sufficient such that in the connected position a distal end portion 76 of the leg member 68 extends through the stud-receiving opening 46 of the rim 42.

In order to stabilize the leg member 68 in the stud-receiving opening 46 of the rim 42 such that upon application of torque to the stud-nut 22 the wrench 60 is not inadvertently removed from the stud-receiving opening 46, the shoulder assembly 70 is secured or supported by the distal end 76 of the leg member 68 and adapted to engage a lower disposed surface of the rim 42 defining the stud-receiving opening 46. Thus, the shoulder assembly 70 secures and stabilizes the leg member 68 in the stud-receiving opening 46 and prevents removal therefrom until such time as the user disengages the shoulder assembly 70 from contact with the lower surface of the rim 42 defining the stud-receiving opening 46.

Various shoulder assemblies can be utilized to secure and stabilize the leg member 68 of the wrench 60 in the stud-receiving opening 46 of the rim 42, or to stabilize the leg member 68 in an abutting relationship with the shoulder 58 of the rim 42 so that the user does not have to employ his hand or foot to stabilize the wrench 60 during the application of torque to the stud-nut 22 of the double cap nut assembly 12.

In FIG. 5 the shoulder assembly 70 is illustrated connected to the distal end portion 76 of the leg member 68. In this embodiment the distal end portion 76 of the leg member 68 is provided with threads 78, and the shoulder assembly 70 comprises a nut 80 threadably positionable on the threaded distal end portion 76 of the leg member 68. In order to stabilize the leg member 68 in the stud-receiving opening 46 of the rim 42, the nut 80 is provided with a diameter greater than the diameter of the stud-receiving opening 46 of the rim 42.

Figure 6A:
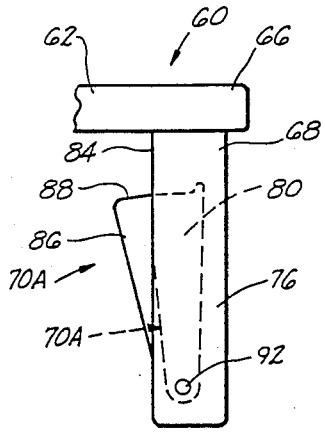
FIG. 6A is a fragmentary, side elevational view of a lower portion of the leg member of the wrench of the present invention, illustrating a second embodiment of the shoulder assembly for securing the leg member in a stud-receiving opening of the wheel assembly, the shoulder assembly being illustrated in an extended wheel engaging position.
Figure 6B:
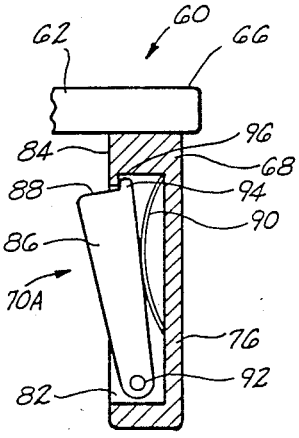
FIG. 6B is a fragmentary, partially cut-away side elevational view of a lower portion of the leg member of the wrench assembly of the present invention and illustrating a cavity for supporting the shoulder assembly thereof such that the shoulder assembly can be selectively moved to a retracted position for insertion through or removal from a stud-receiving opening of the wheel assembly.

Referring now to FIGS. 6A and 6B, a second embodiment of a shoulder assembly 70A is illustrated for securing the leg member 68 of the wrench 60 in the stud-receiving opening 46 of the rim 42. In this embodiment the distal end portion 76 of the leg member 68 is provided with a longitudinally extending slot 82 in one side 84 thereof. A shoulder member 86 is positionable within the elongated longitudinally extending slot 82 of the leg member 68 such that the shoulder member 86 is movable between an extended position (as shown in FIG. 6A) and a retracted position (shown in phantom) wherein the shoulder member 86 is positioned inwardly in the longitudinally extending slot 82 so that the distal end portion 76 of the leg 68, together with the shoulder member 86 can be positioned through the stud-receiving opening 46 of the rim 42 for either placement of the wrench 60 thereon or for removal of the wrench 60. The shoulder member 86, illustrated as a substantially triangularly-shaped member, is provided with an upper rim engaging surface 88 such that in the extended position of the shoulder member 82, the upper rim engaging surface 88 abuttingly engages a lower side portion (not shown) of the rim 42 defining the stud-receiving opening 46 through which the distal end portion 76 of the leg member 68 has been inserted so that the leg member 68 is secured within the stud-receiving opening 46.

In order to maintain the shoulder member 86 in the extended, rim engaging position for stabilizing the leg member 68 in the stud-receiving opening 46 of the rim 42, a leaf-type spring 90 is positioned within the longitudinally extending slot 82 for biasing the shoulder member 86 in the extended position. Further, the shoulder member 86 is pivotally connected to the leg member 68 via a pin 92, substantially as shown, and outward movement of the upper end portion of the shoulder member 82 is restricted by any suitable means, such as providing an extension member 94 on a rearward upper portion of the shoulder member 6, the extension member 94 adapted to travel throughout an elongated slot 96 disposed substantially normal to the elongated slot 78 such that the shoulder member 86 can be moved between the extended position and the retracted position. Further, it should be understood that any suitable means can be employed for connecting the shoulder member 86 to the leg member 68 of the wrench 60 provided that the shoulder member 86 can be selectively moved between the outwardly extending position and a position wherein same is disposed within the longitudinally extending slot 78 formed in the distal end portion 76 of the leg member 68 without departing from the scope of the present invention.

Figure 7:
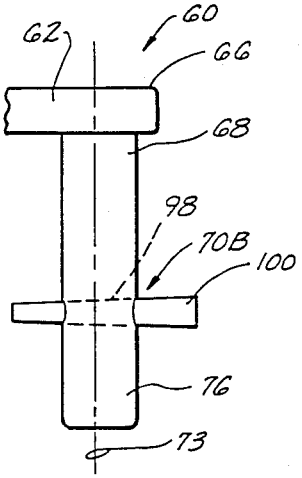
FIG. 7 is a fragmentary, side elevational view of a lower end portion of the leg member of the wrench assembly of the present invention illustrating yet another embodiment of the shoulder assembly for securing the leg member within the stud-receiving opening of the wheel assembly.

Referring now to FIG. 7, another embodiment of a shoulder assembly 70B for securing the leg member 68 of the wrench 60 in the stud-receiving opening 46 of the rim 42 is illustrated. In this embodiment, the distal end portion 76 of the leg member 68 is provided with a tapered bore 98 extending therethrough, the axis of the tapered bore 98 being substantially normal to the elongated axis 73 of the leg member 68. A tapered pin 100 is positionable through the tapered bore 98, and the tapered pin 100 is provided with a length greater than the length of the tapered bore 98. Thus, the tapered pin 100 extends outwardly from the leg member 68 and is adapted to engage the lower side portion of the rim 42 defining the stud-receiving opening 46 through which the distal end portion 76 of the leg member 68 has been inserted. By tapering the bore 98 and the pin 100, one enhances the stability of the pin 100 in the bore 98.

While certain embodiments of the shoulder assembly supportable by the distal end portion 76 of the leg member 68 of the wrench 60 have been illustrated in FIGS. 5, 6A, 6B and 7, it should be understood that other mechanisms can be connected to the distal end portion 76 of the leg member 68 which will function to stabilize the distal end portion 76 in the stud-receiving opening 42, and at the same time prevent the removal of the leg member 68 from the stud-receiving opening 46 upon an application of torque to the stud-nut 22 of the double cap nut assembly 12. For example, a spring biased element having a threaded bore centrally disposed therein could be employed to matingly engage the threads 78 on the distal end portion 76 of the leg member 68 (as shown in FIG. 5) such that the wing members could be moved upwardly to extend along the leg member 68 while the leg member 68 is positioned into the stud-receiving opening 46. Once the wing portions of the device have cleared the rim 42 defining the stud-receiving opening 46, the wing portions would be automatically released which would extend outwardly from the leg member 68 for securing the leg member 68 in the stud-receiving opening 46.

The combination of the leg member 68 and the shoulder assembly 58 of the wrench assembly 70 substantially eliminates the likelihood that the wrench assembly 70 will become disengaged from contact with the rim 42 during use of a pneumatic lug wrench to remove the stud-nut 22 from the outer nut 24 when the leg member 68 is placed adjacent and in frictional engagement with the shoulder 70 of the rim 42 substantially as shown in FIG. 3B.

The operation of the wrench or implement 60 of the present invention will now be described with reference to FIGS. 3A, 3B and 5. However, it should be noted that the operation of the embodiment shown in FIGS. 6A, 6B and 7 would be similar to that of the embodiment shown in FIG. 5.

As shown in FIG. 3B, a double cap nut assembly 12 is disposed within each of the stud-receiving openings (not shown) of the rim 42 of the outer wheel assembly 16. In order to remove the double cap nut assembly 12 from the stud 20 one only needs to apply torque to the stud-nut 22 so that the stud 20 is withdrawn therefrom. However, when the stud-nut 22 and the outer nut 24 have become "frozen" due to usage of the vehicle, the user employs the wrench 60 of the present invention.

In using the wrench 60 the nut-receiving opening 72 formed in the first end portion 64 of the body member 62 is positioned over the outer nut 24 of the double cap nut assembly 12 such that the leg member 68, together with the nut 80, if connected thereto, extends a substantial distance along the shoulder 58 of the rim 42. If required, the stud-nut 22 is rotated until the leg member 68 of the wrench 60 firmly engages the shoulder 58 of the rim 42. Once the leg member 68 has been brought into engagement with the shoulder 58, sufficient torque can be applied to the stud-nut 22 to disengage the stud-nut 22 from the outer nut 24. After the first of the double cap nut assemblies 12 has been removed one of the stud-receiving openings 46 is open. From that point on the leg member 68 of the wrench 60 can be positioned within the stud-receiving opening 46 and thereafter secured within the stud-receiving opening 46 by connection of the nut 80 to the threaded end portion 76 of the leg 68. That is, the nut-receiving opening 72 of the wrench 60 is positioned over one of the adjacent outer nuts 24 of the double cap nut assembly 12 and the distal end portion 76 of the leg 68 is positioned through the stud-receiving opening 46. Thereafter, the nut 80, which functions as a shoulder assembly, is connected to the distal end portion 76 of the leg member 68 such that the nut 80 abuttingly engages the lower side of the rim 42 defining the stud-receiving opening 46 through which the distal end portion 76 of the leg member 68 has been inserted. Application of torque to the stud-nut 22 thereafter will disengage the stud-nut 22 from the outer nut 24. Once the stud-nut 22 has been disengaged from the outer nut 24, the nut 80 is removed from the distal end portion 76 of the leg member 68, so that the wrench 60 can be removed from engaging contact with the outer nut 24 of the double cap nut assembly 12 and the leg member 68 removed from the stud-receiving opening 46. To remove the remaining stud-nuts 22 from the outer nut 24 so that the outer wheel assembly 16 can be removed from the axle hub 18, the procedure described above is repeated until each of the stud-nuts 22 have been removed from their respective outer nuts 24.

Thus, it becomes apparent that the wrench 60 of the present invention provides a simple, inexpensive implement for removing the stud-nuts of a double cap nut assembly from each of their outer nuts. The design of the wrench 60 provides a safety factor for the user which has not been available by such wrenches heretofore. It is clear that the present invention is well adapted to carry out the objects and attain the ends and advantages mentioned as well as those inherent therein. While presently preferred embodiments of the invention have been described for purposes of this disclosure, numerous changes may be made which will readily suggest themselves to those skilled in the art and which are encompassed within the spirit of the invention disclosed and as defined in the appended claims.

What is claimed is:

1. A wrench for use in combination with a lug wrench to remove a stud-nut from an outer nut of a double cap nut assembly employed to secure a wheel assembly to a stud of an axle hub, the wheel assembly having a plurality of equally spaced stud-receiving openings disposed about a hub opening therein, the wrench comprising:

an elongated body member having a first end portion and an opposed second end, the first end portion defining a nut-receiving opening therein having a configuration corresponding to the circumferential configuration of the outer nut of the double cap nut assembly;

a leg member supported by the body member near the opposed second end thereof such that the leg member extends substantially normal to an elongated axis of the body member, the leg member being disposed a distance from a central axis of the nut-receiving opening such that the distance between the central axis of the nut-receiving opening and an elongated centrally disposed axis of the leg member substantially corresponds to the distance between the central axes of adjacent stud-receiving openings in the wheel assembly, the leg member having a length such that a distal end portion thereof extends through the stud-receiving opening when the nut-stud of the double cap nut assembly is disposed in the nut-receiving opening of the body member, the distal end portion of the leg member being threaded; and shoulder means supportable by the distal end portion of the leg member for engaging a portion of the wheel defining the stud-receiving opening and preventing removal of the leg member from the stud-receiving opening when torque is applied to the stud-nut of the double cap nut assembly, the shoulder means comprising:

a nut threadably positionable on the threaded end portion of the leg member, the nut having a diameter greater than the diameter of the stud-receiving opening in the wheel assembly.

2. A wrench for use in combination with a lug wrench to remove a stud-nut from an outer nut of a double cap nut assembly employed to secure a wheel assembly to a stud of an axle hub, the wheel assembly having a plurality of equally spaced stud-receiving openings disposed about a hub opening therein, the wrench comprising:

an elongated body member having a first end portion and an opposed second end, the first end portion defining a nut-receiving opening therein having a configuration corresponding to the circumferential configuration of the outer nut of the double cap nut assembly;

a leg member supported by the body member near the opposed second end thereof such that the leg member extends substantially normal to an elongated axis of the body member, the leg member being disposed a distance from a central axis of the nut-receiving opening such that the distance between the central axis of the nut-receiving opening and an elongated centrally disposed axis of the leg member substantially corresponds to the distance between the central axes of adjacent stud-receiving openings in the wheel assembly, the leg member having a length such that a distal end portion thereof extends through the stud-receiving opening when the nut-stud of the double cap nut assembly is disposed in the nut-receiving opening of the body member, the distal end portion of the leg member having a tapered bore extending therethrough, the axis of the tapered bore being substantially normal to the elongated axis of the leg member; and shoulder means supportable by the distal end portion of the leg member for engaging a portion of the wheel defining the stud-receiving opening and preventing removal of the leg member from the stud-receiving opening when torque is applied to the stud-nut of the double cap nut assembly, the shoulder means comprising:

a tapered pin positionable through the tapered bore in the leg member, the tapered pin having a length greater than the length of the tapered bore so that the tapered pin extends outwardly from the leg member and engages a lower side portion of the wheel assembly defining the stud-receiving opening through which the distal end portion of the leg member extends.

3. A wrench of ruse in combination with a lug wrench to remove a stud-nut from an outer nut of a double cap nut assembly employed to secure a wheel assembly to a stud of an axle hub, the wheel assembly having a plurality of equally spaced stud-receiving openings disposed about a hub opening therein, the wrench comprising:

an elongated body member having a first end portion and an opposed second end, the first end portion defining a nut-receiving opening therein having a configuration corresponding to the circumferential configuration of the outer nut of the double cap nut assembly;

a leg member supported by the body member near the opposed second end thereof such that the leg member extends substantially normal to an elongated axis of the body member, the leg member being disposed a distance from a central axis of the nut-receiving opening such that the distance between the central axis of the nut-receiving opening and an elongated centrally disposed axis of the leg member substantially corresponds to the distance between the central axes of adjacent stud-receiving openings in the wheel assembly, the leg member having a length such that a distal end portion thereof extends through the stud-receiving opening when the nut-stud of the double cap nut assembly is disposed in the nut-receiving opening of the body member, the distal end portion of the leg member having a longitudinally extending slot in one side thereof; and shoulder means supportable by the distal end portion of the leg member for engaging a portion of the wheel defining the stud-receiving opening and preventing removal of the leg member from the stud-receiving opening when torque is applied to the stud-nut of the double cap nut assembly, the shoulder means comprising:

a shoulder member having an upper rim engaging surface;

means for connecting the shoulder member to the leg member such that the shoulder member is movable between an extended position and a retracted position, in the extended position the shoulder member extending outwardly from the longitudinally extending slot and permitting the upper rim engaging surface to engage a lower side portion of the wheel assembly defining the stud-receiving opening therein, in the retracted position the shoulder member being disposed within the longitudinally extending slot of the leg member so that the leg member can be positioned in or withdrawn from the stud-receiving opening of the wheel assembly; and biasing means disposed within the elongated slot of the leg member for biasing the shoulder member in the extended position.

4. A hand implement for use in combination with a lug wrench to remove a stud-nut from a wheel assembly wherein the wheel assembly includes a rim having a shoulder portion formed about a central hub opening and a plurality of equally spaces stud-receiving openings disposed about the central opening therein, and wherein the stud-nut is secured to the wheel assembly by an outer nut of a double cap nut assembly, the hand implement comprising:

an elongated body member having a first end portion and an opposed second end, the first end portion defining a nut-receiving opening therein having a configuration corresponding to the circumferential configuration of the outer nut of the double cap nut assembly;

a leg member supported by the body member near the opposed second end thereof such that the leg member extends substantially normal to an elongated axis of the body member,, the leg member having a length such that a distal end portion thereof extends along the shoulder portion of the rim when the outer nut is disposed in the nut-receiving opening of the body member, the distal end portion of the leg member having a tapered bore extending therethrough, the axis of the tapered bore being substantially normal to an elongated axis of the leg member; and means supportable by the distal end portion of the leg member for engaging the shoulder portion of the rim and preventing rotation of the hand implement when torque is applied to the stud-nut by the lug wrench, the means comprising:

a tapered pin positionable through the tapered bore of the leg member, the tapered pin having a length greater than the length of the tapered bore so that the tapered pin extends outwardly from the leg member and engages a portion of the rim of the wheel assembly and secures the hand implement in a stable, non-rotatable position.

5. A hand implement for use in combination with a lug wrench to remove a stud-nut from a wheel assembly wherein the wheel assembly includes a rim having a shoulder portion formed about a central hub opening and a plurality of equally spaced stud-receiving openings disposed about the central opening therein, and wherein the stud-nut is secured to the wheel assembly by an outer nut of a double cap nut assembly, the hand implement comprising:

an elongated body member having a first end portion and an opposed second end, the first end portion defining a nut-receiving opening therein having a configuration corresponding to the circumferential configuration of the outer nut of the double cap nut assembly;

a leg member supported by the body member near the opposed second end thereof such that the leg member extends substantially normal to an elongated axis of the body member, the leg member having a length such that a distal end portion thereof extends along the shoulder portion of the rim when the outer nut is disposed in the nut-receiving opening of the body member, the distal end portion of the leg member having a longitudinally extending slot in one side thereof; and means supportable by the distal end portion of the leg member for engaging the shoulder portion of the rim and preventing rotation of the hand implement when torque is applied to the stud-nut by the lug wrench, the means comprising:

a shoulder member having an upper rim engaging surface;

means for pivotally connecting the shoulder member to the leg member such that the shoulder member is movable between an extended position and a retracted position, in the extended position the shoulder member extending outwardly from the longitudinally extending slot and permitting the upper rim engaging surface to engage a lower portion of the rim of the wheel assembly, in the retracted position the shoulder member being disposed within the longitudinally extending slot of the leg member; and biasing means disposed within the elongated slot of the leg member for biasing the shoulder member in the extended position.

6. A hand implement for use in combination with a lug wrench to remove a stud-nut from a wheel assembly wherein the wheel assembly includes a rim having a shoulder portion formed about a central hub opening and a plurality of equally spaced stud-receiving openings disposed about the central hub opening therein, and wherein the stud-nut is secured to the wheel assembly by an outer nut of a double cap nut assembly, the hand implement comprising:

an elongated body member having a first end portion and an opposed second end, the first end portion defining a nut-receiving opening therein having a configuration corresponding to the circumferential configuration of the outer nut of the double cap nut assembly;

a leg member supported by the body member near the opposed second end thereof such that the leg member extends substantially normal to an elongated axis of the body member, the leg member having a length such that a threaded distal end portion thereof extends along the shoulder portion of the rim when the outer nut is disposed in the nut-receiving opening of the body member; and means supportable by the distal end portion of the leg member for engaging the shoulder portion of the rim and preventing rotation of the hand implement when torque is applied to the stud-nut by the lug wrench, the means comprising:

a nut threadably positionable on the threaded distal end portion of the leg member, the nut forming a shoulder portion adapted to frictionally engage a portion of the rim of the wheel assembly so as to secure the hand implement in a stable, non-rotatable position.

* * * * *

UNITED STATES PATENT AND TRADEMARK OFFICE

CERTIFICATE OF CORRECTION

PATENT NO. : 4,914,989

DATED : April 10, 1990

INVENTOR(S) : Donald Ray Hendricks et al.

It is certified that error appears in the above-identified patent and that said Letters Patent is hereby corrected as shown below:

Column 6, line 55, delete "shoulder member 6" and substitute therefor -- shoulder member 86--; and Column 10, line 5, delete "of ruse" and substitute --for use- therefor.

Signed and Sealed this

Third Day of December, 1991

*Attest:*

HARRY F. MANBECK, JR.

*Attesting Officer*

*Commissioner of Patents and Trademarks*